US005829296A

United States Patent [19]

Im Brahm et al.

[11] Patent Number: 5,829,296

[45] Date of Patent: Nov. 3, 1998

[54] METHOD AND DEVICE FOR PLACING PLUGS ON A PLUG MILL

[75] Inventors: Walter Im Brahm, Essen; Wilhelm Effertz, Duisburg; Michael Brensing, Düsseldorf, all of Germany

[73] Assignee: Mannesmann Aktiengesellschaft, Düsseldorf, Germany

[21] Appl. No.: 793,436

[22] PCT Filed: Jan. 19, 1996

[86] PCT No.: PCT/FR96/00094

§ 371 Date: Feb. 25, 1997

§ 102(e) Date: Feb. 25, 1997

[87] PCT Pub. No.: WO96/05921

PCT Pub. Date: Feb. 29, 1996

[30] Foreign Application Priority Data

Aug. 25, 1994 [DE] Germany ..... 44 31 389.6

[51] Int. Cl.[6] ..... B21B 25/06

[52] U.S. Cl. ..... 72/209

[58] Field of Search ..... 72/209, 208, 97, 72/250, 41, 43, 201, 202

[56] References Cited

U.S. PATENT DOCUMENTS

| | | | |
|---|---|---|---|
| 3,762,201 | 10/1973 | Schonfeld et al. | 72/209 |
| 3,924,435 | 12/1975 | Franceschina et al. | 72/209 |
| 3,975,937 | 8/1976 | Kamimura et al. | 72/209 |
| 4,038,854 | 8/1977 | Jones | 72/209 |
| 4,127,998 | 12/1978 | Meurer et al. | 72/209 |
| 4,638,655 | 1/1987 | Sebastian et al. | 72/208 |

*Primary Examiner*—Joseph J. Hail, III
*Assistant Examiner*—Rodney Butler
*Attorney, Agent, or Firm*—Cohen, Pontani, Lieberman & Pavane

[57] ABSTRACT

A method and device for placing plugs on plug mills, in which, after the completed rolling of a tube, the plug is freed from bearing against a plug rod and, owing to its weight, moves downward out of the rolling line, is recooled and is raised again into the region of the rolling line. According to the invention, when being raised the plug moves on an elliptical track and, before being deposited, assumes a waiting position which is located at approximately the same level at a lateral spacing from the rolling line.

7 Claims, 5 Drawing Sheets

METHOD AND DEVICE FOR PLACING PLUGS ON A PLUG MILL

BACKGROUND OF THE INVENTION

1. Field of the Invention

The present invention relates to a method and a device for placing plugs on plug mills, and more particularly, to a method and device for placing a plug on the rolling line of a plug mill, moving the plug out of the rolling line once a tube is formed while simultaneously moving another plug onto the rolling line, cooling and/or lubricating the plug, and raising the plug onto the rolling line again.

2. Description of the Prior Art

Devices for placing plugs on plug mills are disclosed in patent numbers DE-A 1752383, GM 7148215 U1, and DE-A 2700589. The devices disclosed in these references position a conical drum below the rolling line configured with a plurality of pockets about its circumference into which the plugs slide after slipping down on a slide. In particular, DE-A 1752383 and GM 7148215 U1 include such a pocket which is positioned at an upper vortex of the device and which is shaped complementary to the shape of the upstream and downstream guidetrack. Patent number DE-A 2700589 accomplishes a similar result by using a pusher to push the plug out of the pocket of the conical drum onto a trough-like rail section which is then pivoted into the rolling line.

Similarly, patent number DE-A 2553580 discloses a device for placing a plug on a plug mill which uses a pivoting device to lift a plug arriving from a slide onto an inclined lift and push it up to the level of tie rolling line. A carriage which can be moved longitudinally on a conveying track arranged obliquely relative to the rolling line accelerates the plug so strongly that it slides into the roll gap by utilizing its kinetic energy.

All the devices discussed previously have the disadvantage that they either require a great deal of space or are not reliable under the conditions of rugged rolling operation, and thus frequently fail. This is particularly true for the conical drum, the size of whose pockets is determined by the largest plug to be used. Smaller plugs are therefore virtually not guided in the pockets, with the result that the smaller plugs may come to rest in the pockets misaligned or facing in the wrong direction, in either case, rendering the plug unusable for rolling. In addition, visual inspection of the plugs as they circulate through the mill is complicated by the mismatch between the drum pocket and plug size.

SUMMARY OF THE INVENTION

It is accordingly an object of the present invention to provide an optimal method and a space-saving lifting device which is capable of faultless operation for a large range of plug dimensions and which permits effective visual checking of the circulating plugs.

The space-saving design is achieved by moving the lifting device along an approximately elliptical path which lies in a plane perpendicular to the rolling line. The long axis of the elliptical path is situated approximately parallel to the sliding line of the plug and offset to the side only slightly relative to the rolling line in the direction of the operating side. The upper vertex of the path lies above the edge of the guide channel of the rolling line. This path shape is achieved by means of a crank drive which has three wheels of equal size, two of which are constructed as spur gears, rotating in the same direction and two intermediate wheels, all pivotably connected via cranks to the lifting device. As a further space saving measure, the location where the plug is taken off before being raised is arranged offset to the side of the rolling line. To move the plug to the offset location, a pivotable lever is arranged at the end of the slide having a trough-shaped lateral extent which forms a continuation of the slide. This lever is connected kinematically to the movement cycle of the lifting device via a push-pull rod which is pivotably fastened to a gear wheel of the crank drive which has a worm gear rim and a spur gear rim. If the plug were to remain in the plane of the rolling line, the fulcrum of the taking-up lever would have to be arranged offset to the side even further from the rolling line so that the gripper of the lifting device can take up the plug from below, resulting in a need for more space.

In a further development of the present invention, a pivotable ejecting element configured as a hollow box having an upper cover is positioned so that the upper cover forms a prism-like support with the lower plug-change lever to supportingly hold a plug in a receiving position. If the element is pivoted, for example by means of a pivoted hydraulic cylinder, this creates a passage opening which permits a damaged plug or fragments thereof to be ejected via a permanently arranged sheet-metal slide The sheet-metal slide is located inside the ejecting element and forms an extension to the pivoted-in lower plug-change lever.

By locating the waiting position at the level of the rolling position and the rolling line, and at a close lateral spacing therefrom, the operator can, while standing on the side of the rolling line, visually monitor the plug, which has previously been recooled, and can lubricate the plug when it is transferred into the rolling line. It is also possible, as an alternative, for the plug to be lubricated by the nozzles used for recooling the plug. Since the waiting position and the rolling position are at the same level, it is advantageously possible to use a manipulator which, in the event of a change in dimension of the plug, can grip the two plugs in circulation and replace them by two new ones. After the two new plugs have been deposited, the two plugs no longer required are moved our and taken to the workshop for measurement and, possibly, remachining of the working part. The manipulator can also be used to raise and carry away the plug from the waiting position which has been rejected during visual inspection.

Instead of a large pocket in accordance with the known conical drum, according to the present invention deposits the plug in the rolling line into a fixed prismatic guide, eliminating misalignment of the plug. However, positioning the plug with its axis as aligned as possible with respect to the rolling line is one of the essential preconditions for faultless operation. In the present invention, the fixed prismatic guide forms a continuous extension of the guide track arranged upstream and downstream thereof.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention. An example of the invention is shown in the drawings and described in greater detail below.

BRIEF DESCRIPTION OF THE DRAWINGS

In the drawings, wherein like reference characters are used to denote similar elements throughout the several views.

DETAILED DESCRIPTION OF THE PRESENTLY PREFERRED EMBODIMENTS

Figure 1:
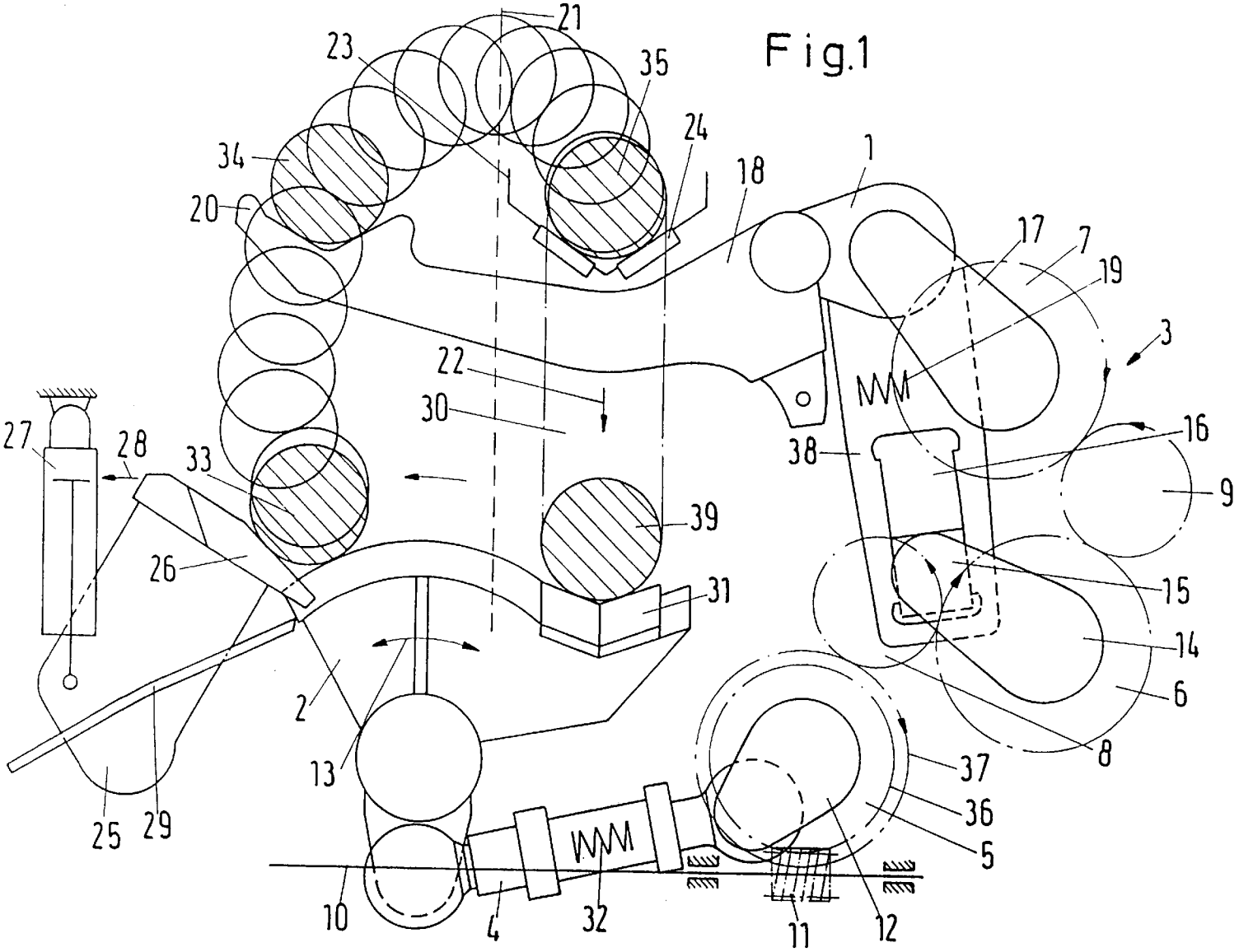
FIG. 1 is a diagrammatic front view of a plug placing device configured in accordance with the present invention.

Referring now to the drawings, and in particular, to FIG. 1, a plug placing device configured in accordance with the present invention includes an upper plug-change lever 1, constructed generally as a gripper, a lower plug-change lever 2, constructed generally as pivoting element, and a crank drive depicted generally at 3 and connecting the upper and lower plug-change levers 1, 2 kinematically to one another. The crank drive 3 further comprises equally sized first, second and third wheels 5, 6, 7, respectively, and two intermediate wheels 8, 9, likewise equally sized with each other, but smaller than wheels 5, 6, 7. All five wheels rotate in the same direction with the intermediate wheels 8, 9 disposed between wheels 5, 6, 7. First wheel 5 further comprises a worm gear rim 36 and a spur gear rim 37, while second and third wheels 6, 7 are constructed as spur gears. A push-pull rod 4 provides additional linkage between the upper and lower plug-change levers 1, 2 via the crank drive 3. The direction of rotation of the five wheels 5, 6, 7, 8, 9 comprising the crank drive 3 is illustrated by arrows in FIG. 1.

The crank drive 3 is driven via a universal joint shaft 10, which is merely schematically indicated here, and is connected to a controllable electric motor (not represented here) via a safety clutch. The first wheel 5, having two gear rims 36, 37, is driven via a worm shaft 11 by means of an appropriate reduction ratio. One gear rim 36 is a worm wheel and the second gear rim 37 is a spur gear; the two are arranged on a common axle.

The push-pull rod 4 is connected to the first wheel 5 via crank 12 provided thereon which in turn moves the push-pull rod 4 in a pivoted fashion as the first wheel 5 rotates. The other end of the push-pull rod 4 is connected in a pivoted fashion to the lower plug-change lever 2. The pivotable direction of this plug-change lever 2 is marked by an arrow 13.

The second wheel 6, constructed as a spur gear, is pivotably connected to the upper plug-change lever 1 via a crank 14, specifically indirectly via a sliding block 15 housed within a cut-out 16 defined in a carrier element 38 provided as part of the upper plug-change lever 1. This sliding block 15 can move back and forth in cutout 16 in the upper plug-change lever 1 (see also FIG. 3). The third wheel 7, likewise constructed as a spur gear, also includes a crank 17 which is pivotably connected to the upper part of the upper plug-change lever 1. The pivotable connection between the gripper arm 18 and carrier element 38 allow the upper plug-change lever 1 to gently take up the plug. A spring 19 provides damping for the pivotability of the gripper arm 18.

The size of the wheels 5, 6, 7 of the crank drive 3, and the kinematics of the individual cranks 12, 147 17 are tuned to one another such that a free end 20 of the gripper arm 18, which takes up the plug and is constructed in the shape of a trough, moves along an approximately elliptical path. This path is situated exactly in a plane perpendicular to the rolling line of the rolling mill and is substantially vertical. The central axis 21 of the elliptical path (represented here as a dashed line) is situated parallel to the slipping line of the plug, indicated by arrow 22, and is somewhat offset from the operating side 30. The upper vertex of this path is defined so that the plug is raised over the edge 23 of the guide track 24 which is constructed in the shape of a prism.

The location at which the plug is taken up by the gripper arm 18 has been offset to the side in the direction of the operating side for the purpose of saving space. In order to provide a support for the plug at this point, the ejecting element 25 has a roof-like cover 26 which forms a prism-like support for the plug by means of a corresponding misaligned position together with the lower plug-change lever 2, as shown more clearly in FIG. 3. A hydraulic cylinder 27 is pivotably connected to the ejecting element 25 as an actuating means with the aid of which the ejecting element 25 can be pivoted, as indicated by the arrow 28 (FIG. 1).

Figure 4:
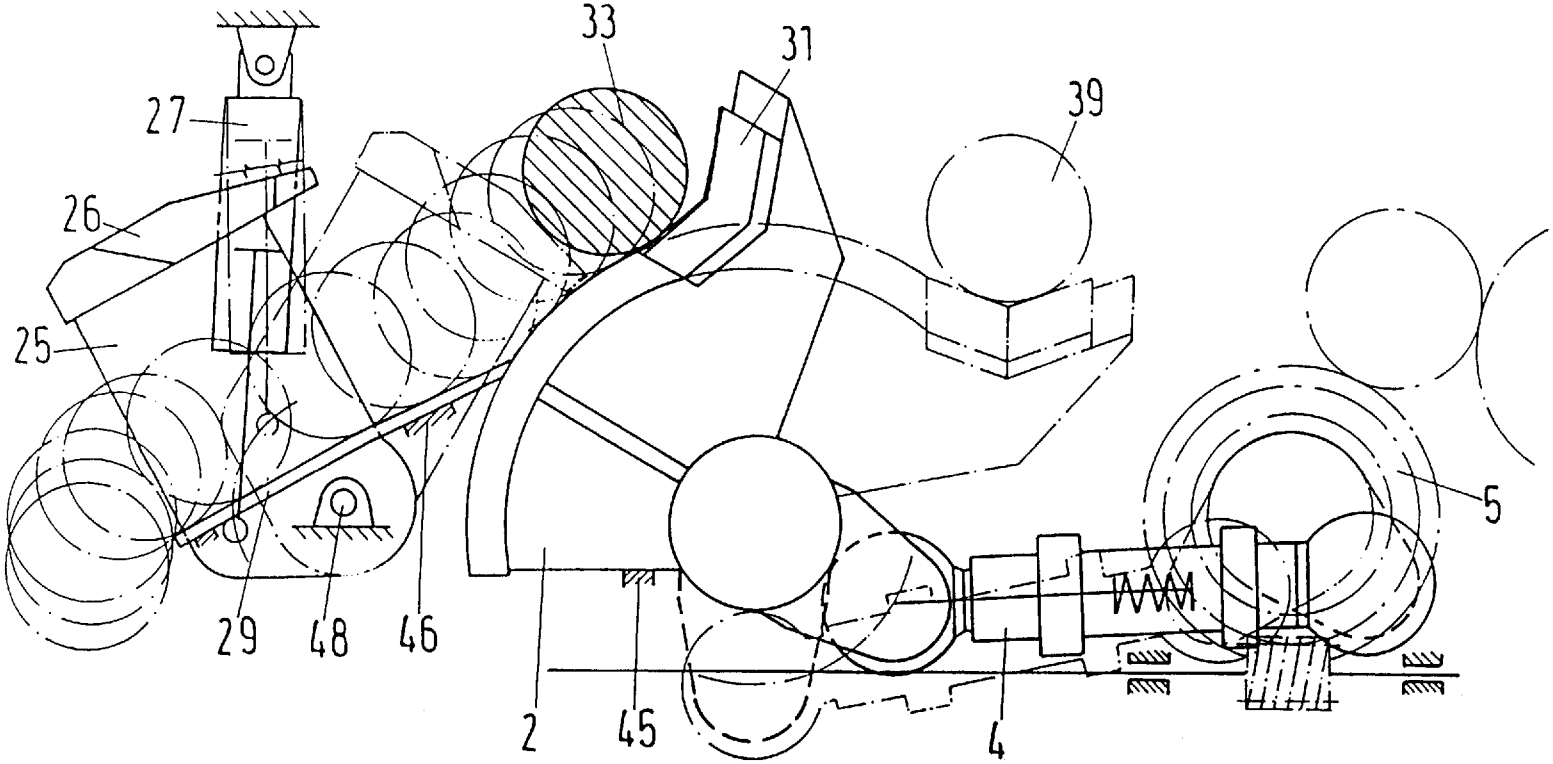
FIG. 4 is a diagrammatic front view of the plug placing device of FIG. 1 illustrating the movement of the ejecting element and lower plug-change lever to eject a damaged plug.

FIG. 4 illustrates how the relative movement of the ejecting element 25 creates a passage through which a damaged plug or its fragments can be ejected along the fixed slide 30.

The general operation of a plug placing device configured in accordance with the present invention during a rolling operation is described below in more detail. In the case of a plug mill, there are, as a rule, always two plugs circulating through the mill the respective working part of the plug having a different diameter, reduced by the wall thickness of the tube to be rolled in conjunction with the appropriate roll pass. After the completed rolling, the plug, removably connected to the mandrel bar, becomes detached and moves downward out of the rolling line under its own weight virtually without lateral offset. To accommodate this, a slide 30 is arranged below the plane of the rolling line. The slipping line along which the plug moves downward is indicated by arrow 22. At the end of the slide 30, the plug comes to rest in collecting position 39 where it may be collected by the trough-like formation of the right-hand extension 31 of the lower plug-change lever 2. The rebound of the plug-change lever 2 in response to the downward force of the plug is dampened by the pivoted push-pull rod 4, wherein a bank of springs 32 is arranged as a damping element therein, A spray nozzle (not shown) may be disposed at the end of the slide 30 for recooling and/or lubricating the plug. The lower plug-change lever 2 is pivoted by the crank drive 3, moving in the direction indicated by arrow 13, and in the process the plug is moved from right to left, i.e. from the collecting position 39 into the receiving position 33 (see also FIG. 3). At this point, the free end 20 of the gripper arm 18 (see also FIG. 2) grips below the plug, and owing to the trough-like construction of the free end 20, the plug is taken along and moved upward along the elliptical path into the waiting position 34. At this point, it can be checked visually for damage or wear of the working part and can be conditioned by the operator, such as by lubrication and/or recooling by a spray nozzle (not shown) disposed near the waiting position 34. If a deviation is detected which is impermissible for further rolling operation, a manipulator (see FIG. 6) can be used to raise the damaged plug out of the waiting position 34 and transport it away.

In the waiting position 34, the plug remains on the free end 20 of the gripper arm 18 until the rolling line is free Thereafter, the gripper aim 18 moves the plug further along the elliptical path beyond the upper vertex and deposits it in guide track 24 in the rolling position 35. Appropriate slots 40 (see FIG. 2) are provided in the guide track 24 so that the free end 20 of The gripper arm 18 can dip down. In this rolling position 35, the plug is carried along in a known way by virtue of the fact that the tube to be rolled is threaded over the cone of the plug, and the plug is pushed right into the roll pass via appropriately constructed guide tracks 24 and brought in the process to bear in a centering fashion on the mandrel bar. The machining cycle previously explained begins anew after rolling has been performed.

In cooperation with the two plugs in circulation, the working cycle is to be understood such that after the plug used for the rolling just performed has slipped downward on the slide 30 in the direction of slipping line 22 and the tube just rolled has been retrieved, the movement cycle of the gripper arm 18 from the waiting position 34 is triggered. From this waiting position 34, the gripper arm 18 follows a movement sequence as it moves through the installation without interruption, that is to say placing a plug in the track 24 in the rolling position 35, passing through to the receiving position 33 and lifting up into the waiting position 34. Appropriate slots 40, 41 are provided at all points where passage of the free end 20 of the gripper arm 18 is required (See FIGS. 2 and 5). It is to be borne in mind in the case of the described movement cycle of the gripper arm 18 that at the same time as the plug is transferred from the waiting position 34 into the rolling position 35 the movement of the lower plug-change lever 2 causes the plug which has slipped down to be moved transversely from the collecting position 39 to the receiving position 33.

The housing embracing the entire device has been left out for the sake of simplicity, since it is not essential to the invention in any case.

Figure 2:
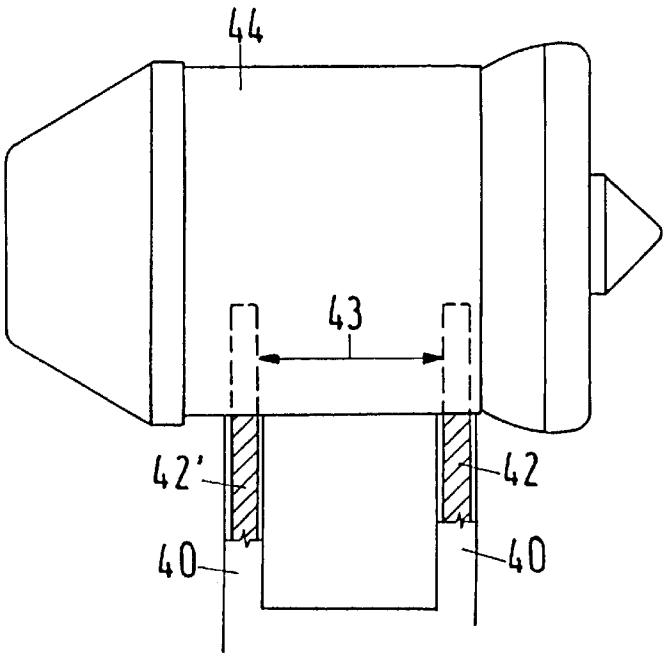
FIG. 2 is a side view of a plug held by the device of FIG. 1 prior to the plug being placed in a guide channel of a rolling mill.
Figure 3:
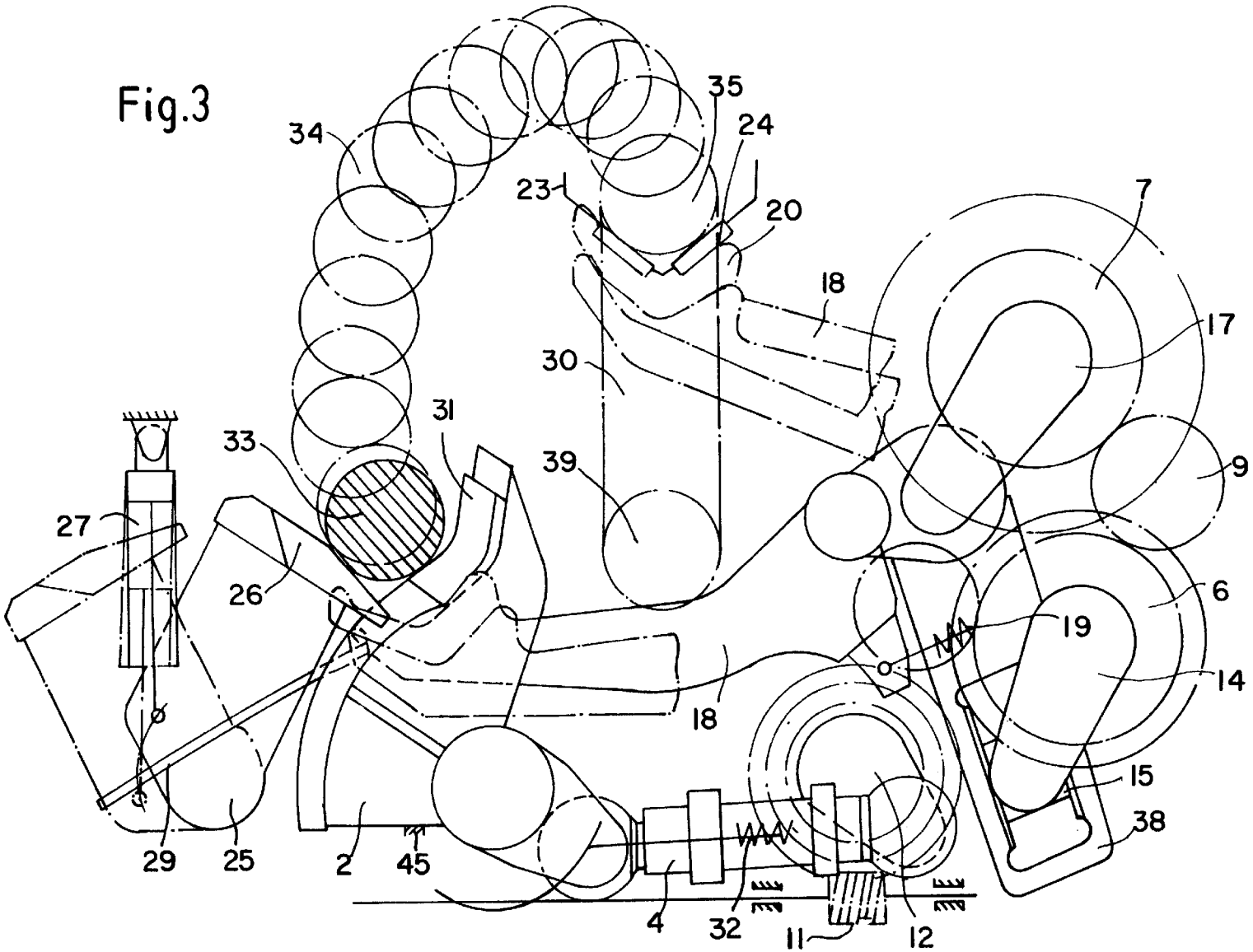
FIG. 3 is a diagrammatic front view of the plug placing device of FIG. 1 illustrating a segment of the elliptical path followed by the device and depicting the gripper arm and plug in the receiving position and in the rolling position.

FIG. 3 shows, in the same view as FIG. 1, the transfer of the plug into rolling position 35 on the rolling line and the taking-up of the plug by the gripper arm 18 in the receiving position 33. As already explained above, the movement cycle of the gripper arm 18 begins from the waiting position 34, in which the plug is at the same level as in the rolling position 35. It is necessary to raise the plug out of the waiting position 34 as far as the upper vertex of the elliptical path, since the plug must be lifted over the edge 23 of the guide track 24. Thereafter, the plug is deposited in the fixed guide track 24, which is constructed like a prism and represents an extension of the guide track arranged upstream and downstream thereof. As already mentioned, slots 40 are arranged in the guide track 24 (see FIG. 2) so that the free end 20 of the gripper arm 18 can dip down through the guide track 24. The gripper of the gripper arm 18 comprises two edgeways sheet-metal webs 42, 42' whose parallel spacing 43 is selected to match the length of the cylindrical guide section 44 of the plug (FIG. 2).

After the plug has been deposited into the rolling position 35 and the gripper arm 18 has dipped down, the upper plug-change lever 1 is moved further by means of the crank 17 and the spur gear 7 of the crank drive 3. After passing through the lower vertex of the elliptical path (not represented here), the gripper arm 18 reaches the receiving position 33 (FIG. 3). This is selected such that the gripper arm 18 can take up the plug from below securely and without misalignment and lift it upward into the waiting position 34. Lateral movement of the plug from the collecting position 39 into the receiving position 33 is performed by means of the pivoting movement of the lower plug-change lever 2, specifically in the phase in which the upper plug-change lever 1 moves the other plug from the waiting position 34 into the rolling position 35. The lower plug-change lever 2 is moved against a stop 45 so that the support, formed like a prism, between a pivoted lower plug-change lever 2 and the ejecting element 25 located in the oblique position is maintained (FIG. 3). Since the crank drive 3 continues running, however, the push-pull rod 4 takes over the further movement in this stationary phase for the lower plug-change lever 2, the push-pull rod 4 being elastically extended. As soon as the plug has been taken up, the lower plug-change lever 2 is moved back into the collecting position 39, i.e. from left to right in the figures. However, on extremely rare occasions, and particularly during the rolling of very short tubes, the plug which has rolled down from the rolling position 35 reaches the end of the slide 30 too early, i e. before the lower plug-change lever 2 has returned to its collecting position 39. A safety plate (not represented here) is pivoted in at the end of the slide 30 so that, in such a case, the plug which is slipping down does not fall in an uncontrolled fashion into the installation. The plug prematurely slipping down would knock against this plate. After the safety plate has been pivoted away, the plug can slip further under the action of its own weight onto the trough-like extension 31 of the lower plug-change lever 2.

Figure 5:
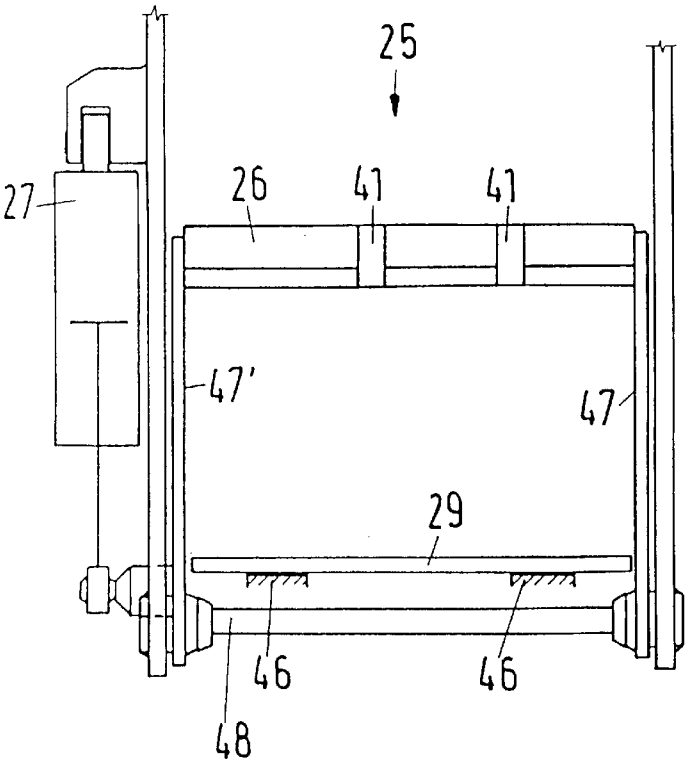
FIG. 5 is a side view of the ejecting element looking in the direction of arrow Y in FIG. 4.

The special situation of the ejection of a damaged plug is represented in FIGS. 4 and 5. Assuming that the operator has detected the impermissible damage in the plug, the operator may modify the movement cycle so that the damaged plug can be ejected. For this purpose, the lower plug-change lever 2 is moved from the collecting position 39 into the receiving position 33 and, at the same time, the ejecting element 25 is moved as shown in FIG. 4 via the dashed and solid lines by means of the hydraulic actuating means 27. This produces a passage opening between the lower plug-change lever 2 and the ejecting element 25, which permits the damaged plug to be ejected downward along the contour of the lower plug-change lever 2 via the fixed member 46 and slide 29, located inside the ejecting element 25. As shown more clearly in FIG. 5, the ejecting element 25 comprises two cheeks 47, 47', which are arranged in parallel and are connected at the lower end by a torsion rod 48. The upper end of the ejecting element 25 has a cover 26 which, together with the lower plug-change lever 2, forms a prism-like support for the plug in the receiving position 33. So that the gripper arm 18 of the upper plug-change lever 1 can dip through the cover 26 when the plug is taken up, corresponding slots 41 are also arranged here. The spacing of the two cheeks 47, 47' and their level are selected such that the largest plug used in the plug mill train can be ejected without difficulty.

Figure 6:
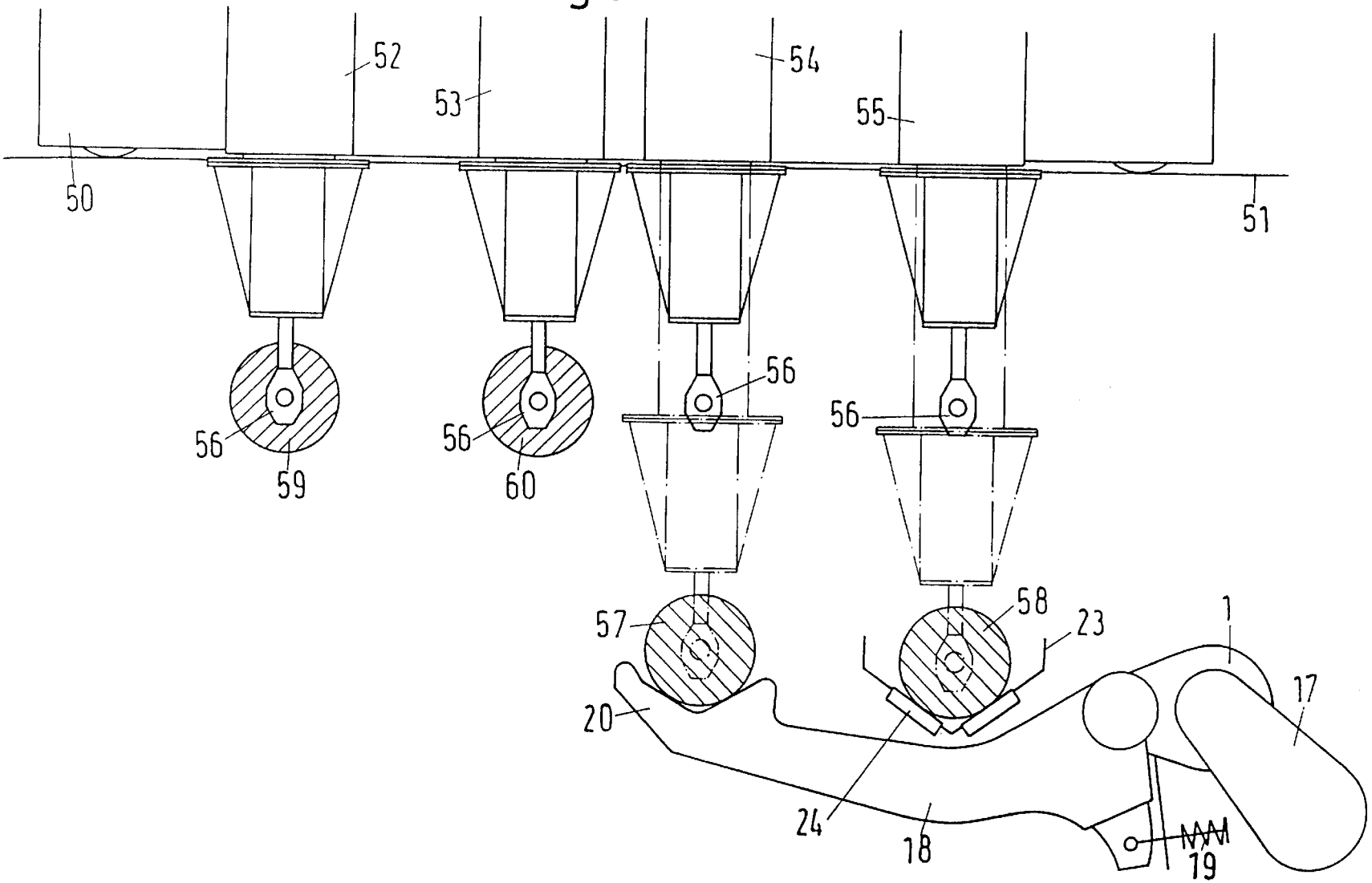
FIG. 6 is a partial view of a manipulator used in conjunction with the plug placing device of FIG. 1.

A manipulator is depicted in FIG. 6 which may be used in conjunction with the plug-change device according to the invention. The manipulator 50 comprises a carriage (only indicated here), which can be moved perpendicular to the rolling line on rails 51. Arranged on the manipulator are four grippers 52 to 55 which can be moved up and down in accordance with the position shown by dashes. Arranged on the lower end of the grippers 52 to 55 are receivers 56 between which the respective plug can be clamped. The identical position, according to the present invention, of the level of the waiting position 34 and the rolling position 35

(see FIG. 1) renders it possible in dee case of a change in dimension of the plug to use the manipulator in a very simple way to grip and raise the two plugs 57, 58 which are to be exchanged. By moving the manipulator, the plugs 59, 60 required for the next rolling dimension can be moved into the appropriate position and then be deposited onto the end 20 of the gripper arm 18, on the one hand, and onto the guide track 24, on the other hand. Thereafter, the two plugs 57, 58 no longer required are moved away and fed to a checking and remachining station.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention, It is the intention, therefore, to be limited only as indicated by the scope of the claims appended hereto.

We claim:

1. A device for placing plugs having working parts on a plug mill having a rolling line and defining a rolling direction, the plug mill including a slide extending generally downward from the rolling line, said device comprising:

a lifting device comprising an upper plug-change lever for raising a plug and a lower plug-change lever for pivoting a plug away from the plug mill, said upper plug-change lever further comprising a gripper arm; and a crank drive comprising first, second and third cranks and a push-pull rod for kinematically connecting said upper plug-change lever and said lower plug-change lever, said gripper arm being connected to said crank drive at two locations, and said lower plug-change lever being pivotably connected to said push-pull rod;

wherein said gripper arm being configured and connected to said crank drive for movement through a movement sequence along a substantially elliptical path on a plane substantially perpendicular to the rolling direction of the rolling line and wherein said movement sequence begins and ends at a location along said elliptical path that defines a waiting position.

2. The device as defined in claim 1, wherein said gripper arm includes a free end having two mutually spaced, parallel edgeways metal webs configured generally as a trough and being sized and shaped to carry a plug, and said free end of said gripper arm is movable without interference through said movement sequence.

3. The device as defined in claim 1, wherein said crank drive further comprises:

first, second and third wheels arranged for rotation in a rotative direction and having substantially the same size;

two intermediate wheels arranged between said first, second and third wheels;

a worm gear shaft; and a sliding block arranged on said second crank;

wherein said first wheel includes a spur gear rim and a worm gear rim arranged for engagement with said worm gear shaft, said first wheel cooperating with said lower plug-change lever via said first crank and said push-pull rod;

wherein said second wheel is configured as a spur gear, said second wheel cooperating with said upper plug-change lever via said sliding block; and wherein said third wheel is configured as a spur gear, said third wheel cooperating with said upper plug-change lever via said third crank.

4. The device as defined in claim 1, further comprising:

a pivotable ejecting element configured as a hollow box and having a cover; and actuating means connected to said ejecting element for pivotable movement of said ejecting element;

wherein said cover and said lower plug-change lever are selectively movable to define together a generally prism-like receiving position for holding a plug for pick-up by said gripper arm.

5. The device as defined in claim 1, further comprising a manipulator disposed proximate said waiting position, said manipulator being movable transverse to the rolling direction of the rolling line and including at least two grippers configured for taking up two plugs.

6. The device as defined in claim 4, wherein said ejecting element further comprises a non-pivotable slide permanently affixed in said ejecting element, said slide being arranged to form an extension of said lower plug-change lever when said lower plug-change lever is pivoted toward said ejecting element.

7. The device as defined in claim 5, wherein said manipulator includes four grippers.

* * * * *